United States Patent [19]

Kajiyama et al.

[11] Patent Number: 4,515,246

[45] Date of Patent: May 7, 1985

[54] APPARATUS FOR CONTROLLING THE ARRIVAL OF AN ELEVATOR CAGE AT AN ELEVATOR FLOOR

[75] Inventors: Ryuichi Kajiyama, Inazawa; Masashi Yonemoto, Nagoya, both of Japan

[73] Assignee: Mitsubishi Denki Kabushiki Kaisha, Tokyo, Japan

[21] Appl. No.: 466,514

[22] Filed: Feb. 15, 1983

[30] Foreign Application Priority Data

Feb. 23, 1982 [JP] Japan ..... 57-27689

[51] Int. Cl.[3] ..... B66B 1/18

[52] U.S. Cl. ..... 187/29 R

[58] Field of Search ..... 187/29, 29 R

[56] References Cited

U.S. PATENT DOCUMENTS

| | | | |
|---|---|---|---|
| 3,589,474 | 6/1971 | Wavre | 187/29 R |
| 3,743,055 | 7/1973 | Hoelscher et al. | 187/29 R |
| 3,747,710 | 7/1973 | Winkler | 187/29 R |
| 3,783,974 | 1/1974 | Gilbert et al. | 187/29 R |
| 4,128,142 | 12/1978 | Satoh et al. | 187/29 R |
| 4,136,758 | 1/1979 | Tachino | 187/29 R |
| 4,351,416 | 9/1982 | Terazono et al. | 187/29 R |
| 4,354,576 | 10/1982 | Kajiyama | 187/29 R |
| 4,356,896 | 11/1982 | Tamura et al. | 187/29 R |

*Primary Examiner*—B. Dobeck
*Assistant Examiner*—Paul Shik Luen Ip
*Attorney, Agent, or Firm*—Leydig, Voit, Osann, Mayer and Holt, Ltd.

[57] ABSTRACT

An apparatus for controlling the arrival of an elevator cage at a target elevator floor in which the elevator cage is not stopped at an intermediate position between adjacent floors even when a detection displacement occurs when the actual cage position and a calculated cage position do not correspond wherein said cage is stopped at said target floor when it is detected that said actual cage position is less than or equal to said calculated elevator position and said cage is stopped at an adjacent floor to said target floor when said calculated cage position is greater than said calculated cage position.

10 Claims, 18 Drawing Figures

APPARATUS FOR CONTROLLING THE ARRIVAL OF AN ELEVATOR CAGE AT AN ELEVATOR FLOOR

BACKGROUND OF THE INVENTION

The present invention relates to an improvement in an apparatus for controlling the arrival of an elevator at a given elevator floor.

It is well known in the art that a floor selector may be used in a multi-story building for instructing the destination direction of an elevator cage or a target floor to be stopped by registering a floor calling and a cage calling.

Since microcomputers have recently been introduced a multi-story building floor selector which employs a microcomputer has been proposed. This selector operates as indicated below:

(1) A pulse is generated every time the elevator cage runs a predetermined distance.

(2) The above-described pulse is added or subtracted according to the running direction namely the upward or downward direction of the cage, and the present position of the cage is calculated from the number of pulses relative to a given reference position.

(3) The number of pulses for each floor in a plurality of floors to be stopped at is prestored in a memory.

(4) A position which is calculated in advance-according to the rated speed of the cage and which is prestored in the above-described memory (and hence the floor position which precedes from the position of the cage) is outputted from the memory and is calculated as the preceding position to decelerate and stop the cage with respect to the elapsed time after the cage is started.

(5) When the cage is called from a floor which is within the range of the preceding position (when the number of pulses for the floor from which the cage is called coincides with the preceding position), the deceleration of the cage to this target floor is determined.

(6) When the deceleration is determined, the number of pulses for the floor from which the cage is called and the remaining distance from the present position of the cage calculated in the above step (4) to a target floor to be stopped are calculated, and a deceleration instruction value corresponding to the remaining distance is produced.

However, if in step (1) or (2) the pulse count is erroneous, and the position of the cage is erroneously detected (heretofore termed as a "detection displacement") the deceleration of the cage is not carried out for the proper position, and the remaining distance which is calculated in step (6) becomes incorrect. Accordingly, the deceleration instruction value corresponding to the remaining distance gradually decreases not towards the actually existing floor but towards a position where no floor exits. In other words, if an erroneously detected target position for the cage to be stopped is produced and if the actual floor position is ahead of the erroneous target position, the cage approaches the actual floor with a deceleration instruction value lower than the proper value. On the other hand, if the actual floor position is located after the erroneously calculated target position, the cage approaches the actual floor with a deceleration instruction value higher than the proper value. Further, in both cases, an abnormal speed detector is operated to produce an abrupt stop instruction, the cage is thus stopped at an intermediate position between adjacent floors, and passengers in the cage are trapped in the cage.

SUMMARY OF THE INVENTION

Accordingly, the present invention has been made in order to eliminate the disadvantages mentioned above, and has its object to provide an apparatus for controlling the arrival of an elevator at an elevator floor wherein the elevator cage is not stopped at an intermediate position between adjacent floors even when a detection displacement is produced by stored values of calculated remaining distances between the cage and a target floor when the cage arrives at a calculated remaining position before a predetermined distance from the target floor or when the calculated remaining distance is greater than the predetermined distance in the case where the cage arrives at a position before the predetermined distance from the target floor.

In the present invention, when the cage arrives at a calculated remaining position before a predetermined distance from a target floor, a deceleration instruction value corresponding to the remaining distance is produced an maintained until a first position detector is activated. Thus, even if the floor position due to the detection displacement is disposed before the actual floor position, the cage can be prevented from stopping at an intermediate position between the adjacent floors.

Further, when the calculated remaining distance is greater than the predetermined distance in the case where the cage arrives at the position before the predetermined distance from a target floor, the deceleration instruction value is maintained until the second position detector of the target floor is operated, the calculated remaining distance is thereafter set to the predetermined distance, and the value is maintained until the first position detector of the next storey is activated. Thus, even if the floor position due to the detection displacement is disposed at a preceding position from the actual floor position, the cage can be operated at a relatively high speed through a door opening and closing capability zone, and the stoppage of the cage at the intermediate position between the adjacent floors can be prevented.

DETAILED DESCRIPTION OF THE PREFERRED EMBODIMENTS

A preferred embodiment of the invention will be described with reference to FIGS. 1 through 16.

Figure 1:
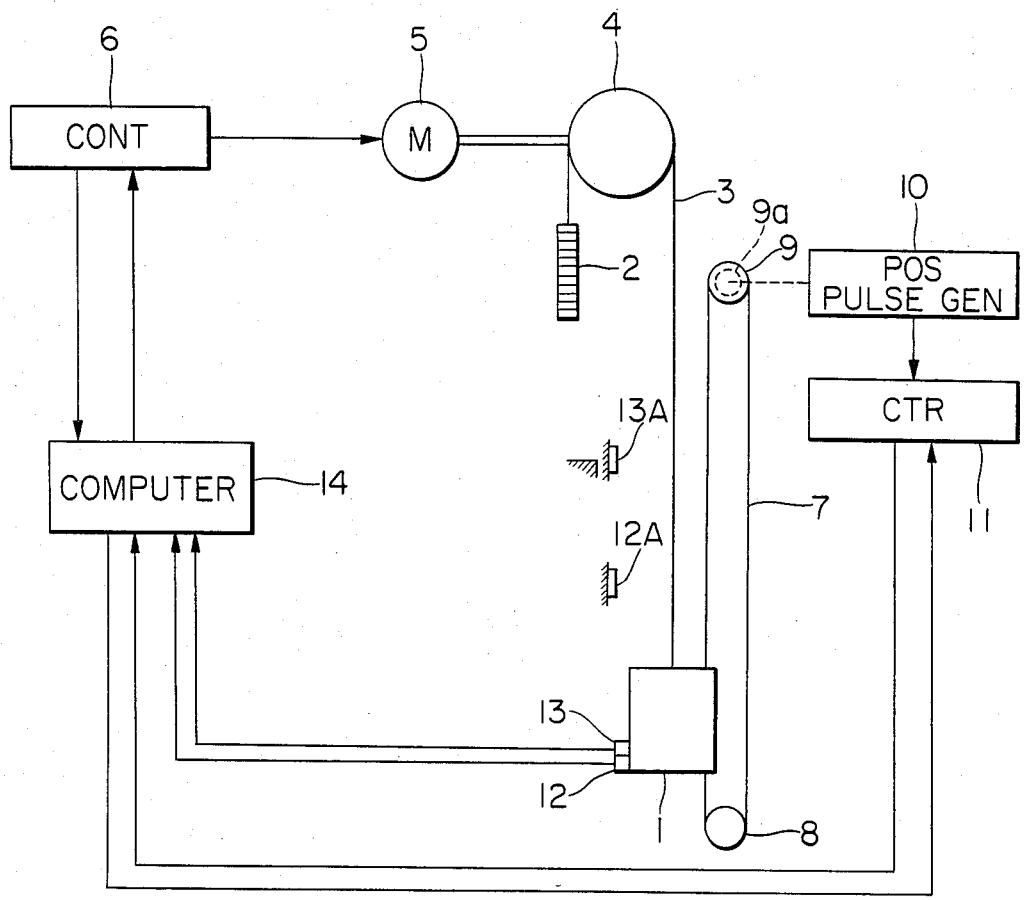
FIG. 1 is a structural diagram showing a first embodiment of an apparatus for controlling the arrival of an elevator cage at a floor according to the present invention.
Figure 2:
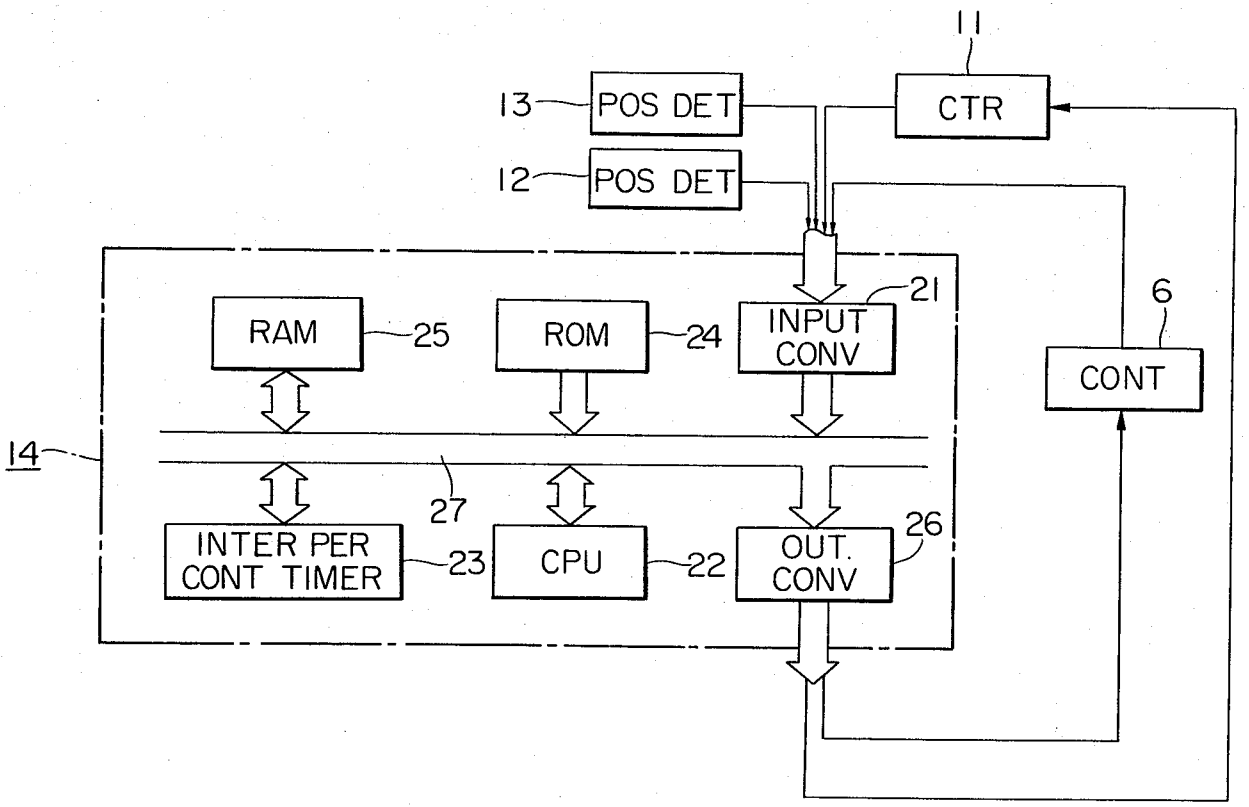
FIG. 2 is a block diagram showing the computer section in FIG. 1.

In FIGS. 1 and 2, reference numeral 1 designates an elevator cage, numeral 2 a balance weight, numeral 3 a main cable for coupling the cage 1 to the balance weight 2, numeral 4 a sheave of a hoisting machine on which the main cable 3 is wound, numeral 5 a hoisting motor for driving the sheave 4 and 6 a controller for controlling the speed of the motor 5. The controller 6 is as descrived in Federic Owen Johnso et al. Japanese Pat. No. 1,103,157 (Patent Publication No. 56-39152) "Converter Apparatus" (Correspond to U.S. Ser. No. 238,916). Reference numeral 7 designates a rope which is coupled at both ends to the cage 1 and which formes an endless loop, numeral 8 a tension sheave laid at the bottom of a hoistway for applying tension to the rope 7, numeral 9 a disc which is disposed in the elevator machine room, over which the rope 7 is wound and which has a number of small holes 9*a* cut in the periphery thereof at equal intervals, numeral 10 a position pulse generator for generating a pulse whenever a small hole 9*a* in the disc 9 traverses therethrough, numeral 11 a counter for adding the generated pulses when the cage 1 moves upwardly and for calculating the present position of the cage 1 and subtracting the generated pulses when the cage 1 moves downwardly, numeral 12 a first position detector such as a switch which is provided on the cage 1 and which opens and closes upon engagement of an engaging element 12A installed in the hoistway when the cage 1 arrives at a position L before a predetermined distance from the storied floor, numeral 13 a second position detector which opens and closes upon engagement and disengagement with an engaging element 13A when the cage 1 is disposed and not disposed in the door openable zone of a storied floor, respectively, and numeral 14 an electronic computer such as a microcomputer. In FIG. 2, reference numeral 21 designates an input converter for converting an input into information in the computer, numeral 22 a central processing unit (CPU), numeral 23 a timer for controlling the interrupt period, numeral 24 a read-only memory (hereinafter termed "ROM") in which elevator controlling programs, deceleration instruction values, and absolute floor position are stored, numeral 25 a random access memory (hereinafter termed "RAM") for storing data in respective memory addresses, numeral 26 an output converter for converting information in the computer into signals for controlling the elevator equipment, and numeral 27 a bus such as an address bus, a data bus, etc.

In FIGS. 5 through 15, reference numerals 51 to 53, 61 to 64, 71 to 74, 81 to 84, 101 to 111, 112 to 121, 122 to 123, 124 to 125, 131 to 136, 141 to 143, 151 respectively designate the operating sequences of the computer 14.

The operation of the above-described embodiment of the present invention will be described hereinbelow.

The general operation of the embodiment will first be described.

When the cage 1 is called at a floor and the call is registered, thereby applying a start instruction to the cage 1, an acceleration instruction value which increases as a function of time is outputted from the computer 14 to the controller 6. Throughout this description the terms "acceleration instruction value" and "deceleration instruction value" are used; the term "speed instruction value" is sometimes used and can be either an "acceleration instruction value" or a "deceleration instruction value". As the motor 5 is started by the controller 6, the cage 1 starts running through the sheave 4. The movement of the cage 1 is transmitted to the disc 9 through the rope 7. Thus, a pulse is generated by the position pulse generator 10, and is added or subtracted by the counter 11. This pulse is fed into the computer 14, which inturn calculates the present position of the cage 1. When the start instruction is applied to the computer, the preceding position data stored in the ROM 24 is read in response to the lapse of the time after the start, and is added to or subtracted from the floor position data of the starting floor, thereby the preceding position of the cage can be calculated. When the preceding position of the cage coincides with the data stored in the ROM 24 for the floor from which the cage is called (hereinafter refered to as "floor position data"), a deceleration instruction is outputted to the controller 6. Simultaneously, the difference between the present position of the cage 1 and the floor position data of the floor (the target floor) from which the cage 1 is called and hence the remaining distance is calculated, a deceleration instruction value corresponding to the calculated remaining distance is outputted from the ROM 24, and is fed into the controller 6. The cage 1 starts decelerating toward the target floor in accordance with the deceleration instruction value. The deceleration instruction value decreases in response to the sequentially calculated remaining distances. Thus, the cage 1 can be precisely controlled to arrive at the target floor.

When the position pulse generator 10 or the counter 11 erroneously operates or counts due to certain causes (e.g., a noise), the present position of the cage 1 calculated by the computer 14 is displaced from the actual cage position. Due to this detection displacement, the calculated remaining distance also becomes an erroneous value. Thus, a normal deceleration instruction value cannot be outputted. That is, (A) When the calculated remaining distance is less than the actual remaining distance, the cage is stopped at a point before the actual target floor (floor level).

(B) When the calculated remaining distance is greater than the actual remaining distance, the cage is stopped at a point beyond the actual target floor to be stopped at.

In the elevator, a cage speed monitor is generally provided to monitor for excessive speeds, abnormally low speeds and the door opening allowable speed (the cage speed wherein the cage door is allowed to open). Accordingly, in the case of the above paragraph (A), the abnormally low speed of the cage is detected, while in the case of the above paragraph (B), the fact that the speed of the cage at a time of passing the door opening and closing capability zone exceeds the door opening allowable speed is detected. Consequently, the cage 1 is abruptly stopped. Since the restart of the cage 1 is generally prevented when the cage speed monitor is operated, it becomes impossible to restart the cage 1.

Figure 3A:
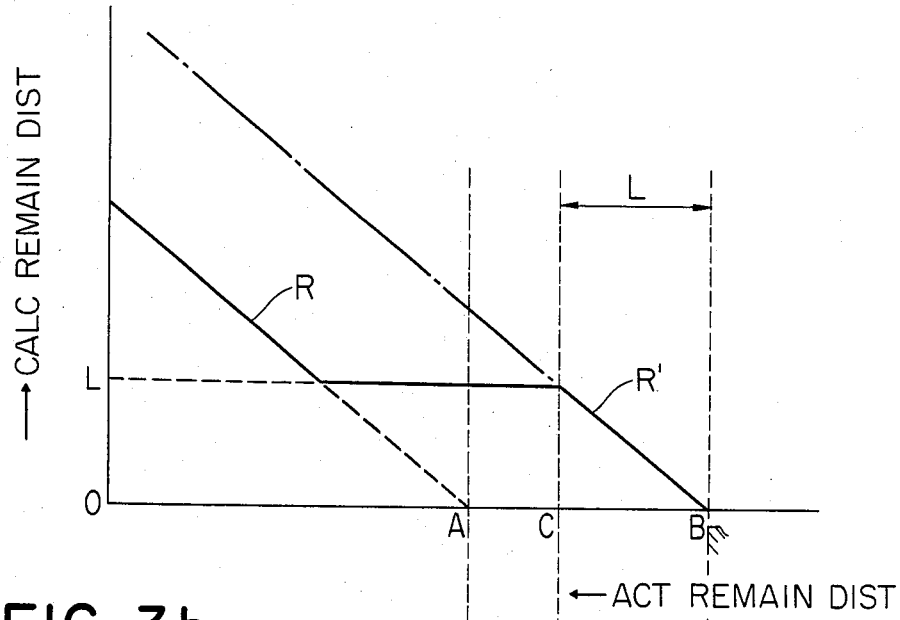
FIGS. 3 and 4 are graphical representation showing calculated remaining distance and speed instruction value curves of FIG. 1.
Figure 3B:
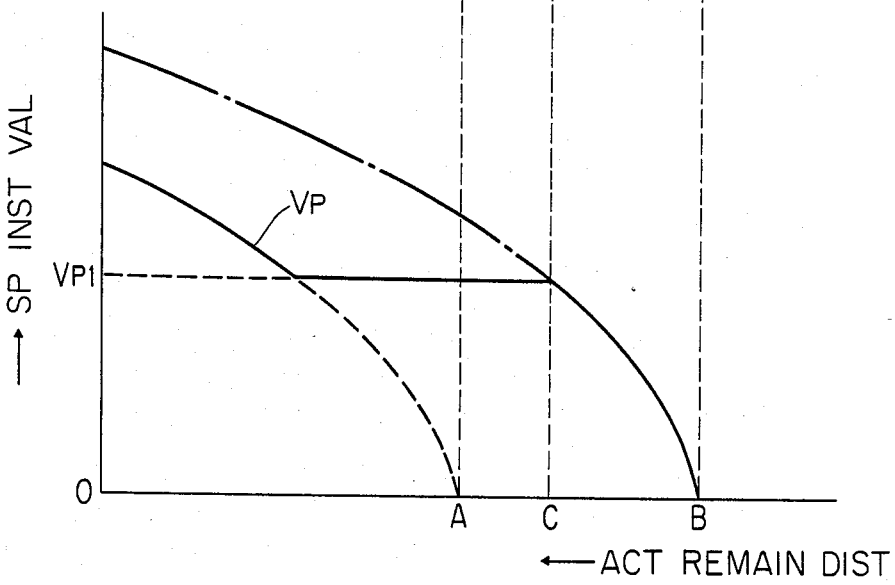
Figure 4A:
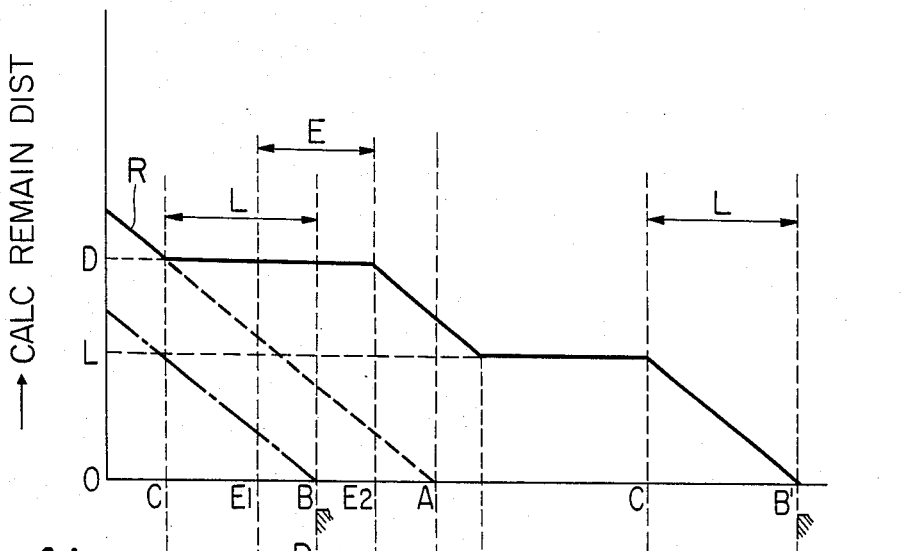
Figure 4B:
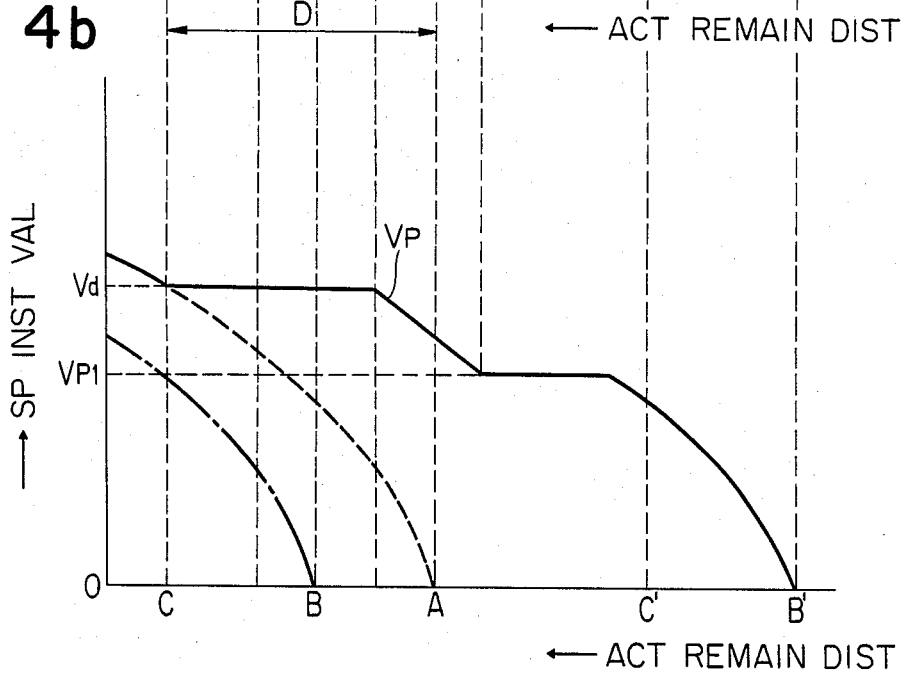

However, in the embodiment described above, the speed monitor can be operated even in the above-described case. This will be described with reference to FIGS. 3 and 4. FIG. 3 shows the case where the calculated remaining distance is less than the actual remaining distance, and FIG. 4 shows the case where the calculated remaining distance is greater than the actual remaining distance. FIGS. 3(*a*) and 4(*a*) illustrate the relationship between the calculated remaining distance and the actual remaining distance, and FIGS. 3(*b*) and 4(*b*) illustrate the relationship between the speed instruction value and the actual remaining distance.

As indicated in FIG. 3(*a*), the cage 1 is decelerated toward the floor at position A and the calculated remaining distance R is gradually decreased. When the calculated remaing distance R becomes the distance L, the first position detector 12 is, when no detection displacement exists, activated.

However, for the case where the first position detector 12 is not yet activated, the calculated remaining distance R is maintained at the distance L when the first position detector 12 traverses the engaging element 12A at the actual remaining distance C located at a predetermined distance L from the target floor B, the holding of the cage can be released. Thereafter, the cage arrives at the target floor B and is stopped.

When the calculated remaining distance is thus processed, the speed instruction value $V_p$ is as indicated in FIG. 3(*b*). In other words, the speed instruction value $V_p$ is outputted from the ROM 24 as the value corresponding to the calculated remaining distance R. Then, the speed instruction value $V_p$ is maintained at the value $V_{p1}$ corresponding to the calculated remaining distance L. Subsequently, only after the first position detector 12 is activated does the calculated remaining distance R' start decreasing. Thus, the speed instruction value $V_p$ is decreased, the cage 1 arrives at the target floor B and is then stopped.

When the cage 1 is, as shown in FIG. 4(*a*), decelerated toward a floor at position A, and a detection displacement exists, the calculated remaining distance R is gradually decreased. As the first position detector 12 is activated at the position C, the calculated remaining distance R is greater than the distance L. (If no detection displacement occurs, the distance R is equal to the distance L). When the first position detector 12 is activated, the calculated remaining distance R is maintained at a distance D. Then, the operation of the arriving cage 1 at the floor A is temporarily stopped. Further, the cage 1 is passed through one end $E_2$ of the door opening and closing capability zone E of the floor B and the second position detector 13 is passed by the engaging element 13A. Then, the holding of the cage is released, and the stop operation of the arriving cage 1 at the floor A is restarted. When the first position detector 12 is not activated in the case where the calculated remaining distance R decreases to become the distance L, the calculated remaining distance R at this point is again maintained at the distance L. When the first position detector 12 is activated when the cage 1 arrives at the position C' at a predetermined distance L before the next floor B' of the floor B, the holding state of the cage can be released. Thereafter, the cage is operated in the same manner as shown in FIG. 3(*a*), and the cage 1 can be stopped at the next floor B.

When the calculated remaining distance is thus processed, the speed instruction value $V_p$ is as shown in FIG. 4(*b*). That is, when the first position detector 12 is operated, the speed instruction value $V_p$ is maintained at a value $V_d$. Simultaneously, the operation of the arriving cage 1 at the floor A is temporarily stopped. Consequently, the door of the cage 1 does not opened during the time the cage 1 passes the door opening and closing capability zone E, and the monitor for controlling the door in the door opening allowable speed is not allowed to operate as well. The operation of the arriving cage 1 at the floor A is continued through the door opening and closing capability zone E and the cage 1 runs toward the next floor B'. Subsequently, as described with respect to FIG. 3(*b*), the speed instruction value $V_p$ is processed, and the cage 1 arrives at the next floor B' and stopped.

Figure 5:
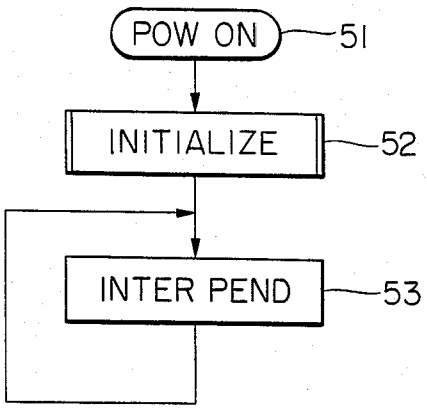
FIGS. 5 to 15 are flow charts illustrating the operation of the computer in FIG. 2.

Next, the operation of the cage with respect to the computer 14 will be described with reference to the flow charts. The computer 14 is operated by a program as shown in FIG. 5 stored in the RAM 25.

At step 51, power is applied to the computer 14, an initialization is automatically set in the computer 14 in the next step 52, and is advanced to step 53 for an interrupt pending.

Figure 6:
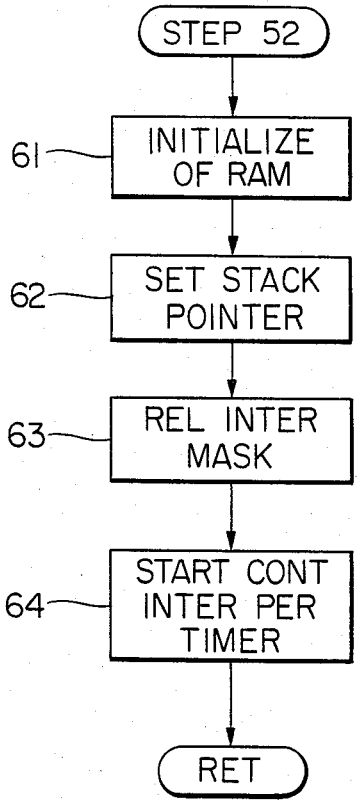

As shown in FIG. 6, the step 52 of the initialization comprises step 61 of initializing the RAM 25, step 62 of setting a stack pointer, step 63 of releasing an interrupt mask and step 64 of starting the timer 23 for controlling the interrupt period.

Figure 7:
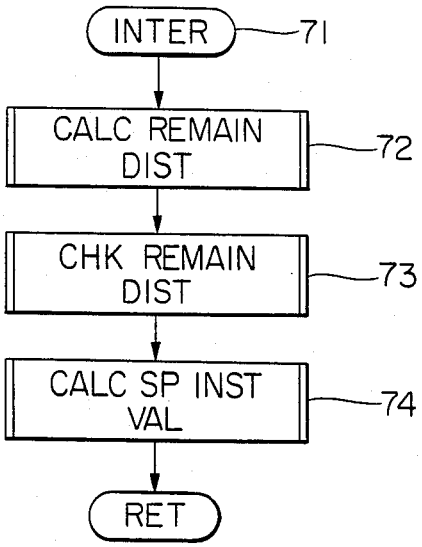

Step 71 in FIG. 7 indicates the execution of the following program when an interrupt from the timer 23 exits. That is, the step 71 comprises step 72 of calculating the remaining distance of the cage, step 73 of checking the remaining distance of the cage, and step 74 of calculating the speed instruction value.

Figure 8:
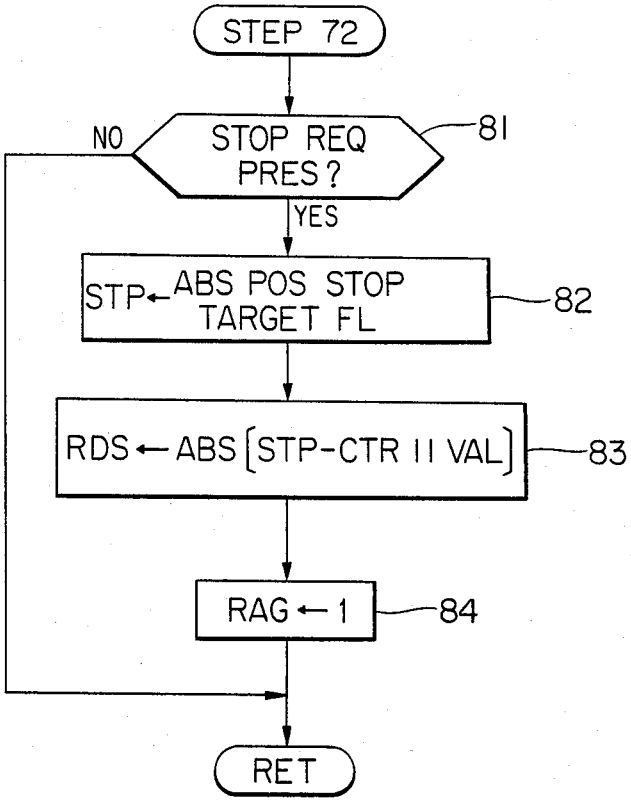

FIG. 8 illustrates the details of the step 72 of calculating the remaining distance. In step 81, it is determined whether or not a stop request exists from the cage 1, and when the request exists, an absolute value corresponding to the target floor is read from a predetermined address in the ROM 24, and is loaded into a predetermined address in the RAM 25 as a STP. In step 83, the value of the counter 11 and hence the present position of the cage 1 is inputted, the absolute value of the difference between this and the STP is loaded as the calculated remaining distance RDS in a prescribed address of the RAM 25, and in step 84, a flag RAG representative of the start of the calculation of the remaining distance is set to "1".

Figure 9:
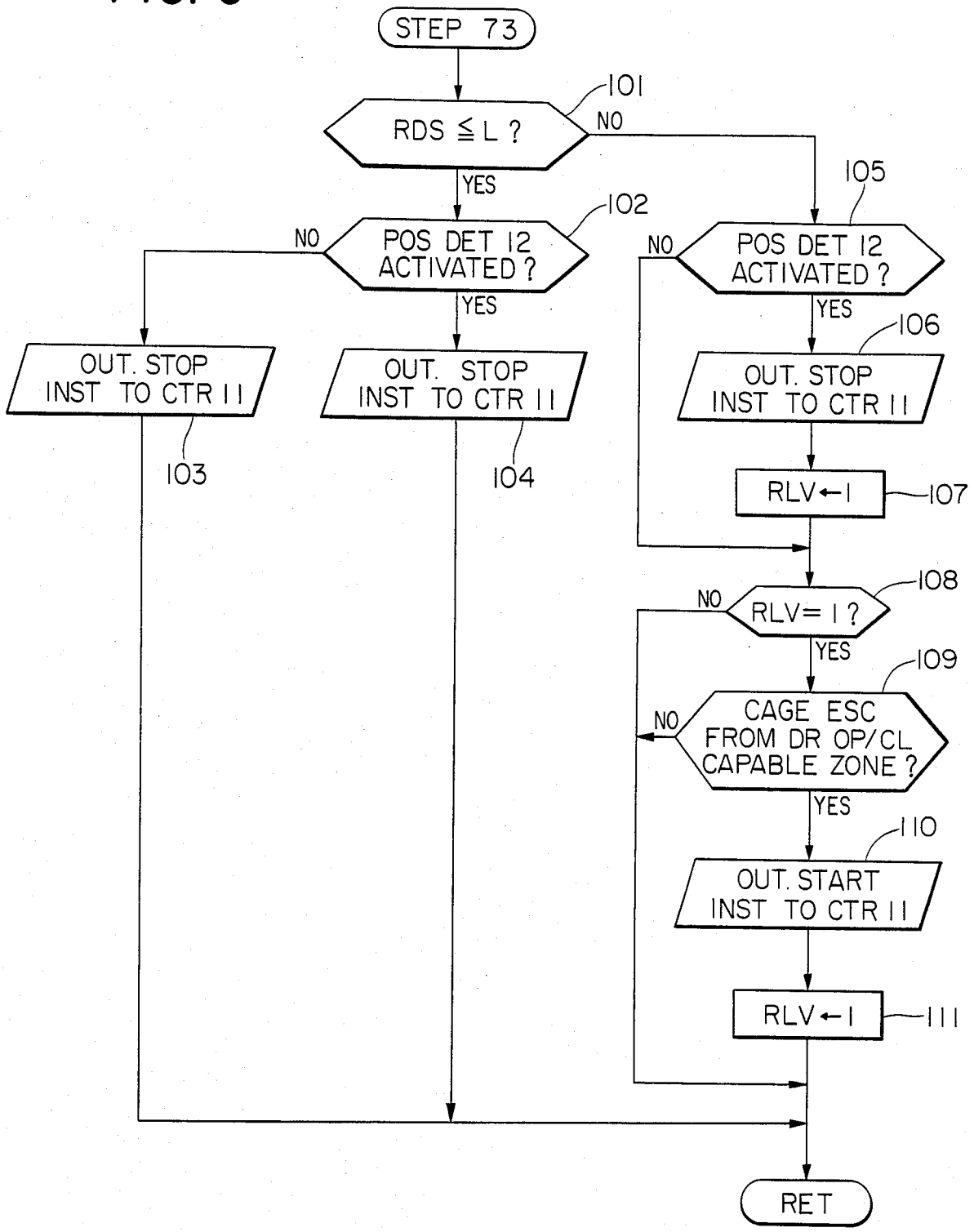

FIG. 9 illustrates the step 73 of the checking the remaining distance.

In step 101, the calculated remaining distance RDS is compared with the distance L, in case of $RDS \leqq L$, the step is advance to step 102, while in case of $RDS > L$, the step is advanced to step 105. In the step 102, the operating state of the first position detector 12 is checked, and when the detector 12 is activated, the step is advance to step 104. When the detector 12 is not activated, a detection displacement occurs. Then, in step 103, a count stop instruction is outputted to the counter 11. Further, the value of the counter 11 and hence the present position of the cage 1 is maintained constant until a count start instruction is outputted in step 104, whereby the calculated remaining distance RDS is maintained at the distance L. In step 105, the operating state of the first position detector 12 is checked. Since the detector 12 is not normally activated, the step is advanced to step 108. When a detection displacement occurs, the detector might sometimes be activated, but in this case a count stop instruction is outputted to the counter 11 in step 106, and a flag RLV is set to "1" in the next step 107. In step 108, the state of the flag RLV is determined. When the flag RLV is set to "1", it is checked whether or not the cage 1 has passed the door opening and closing capability zone as illustrated in the next step 109. When the cage has passed the zone, a count restart instruction is outputted to the counter 11 as in step 110, and the flag RLV is reset to "0" as in step 111. In other words, for the case where the first position detector 12 is operated and $RDS > L$ due to a detection displacement, the counting operation of the counter 11 is stopped until the cage 1 has passed the door opening and closing capability zone, whereby the calculated remaining distance RDS is maintained.

Figure 10:
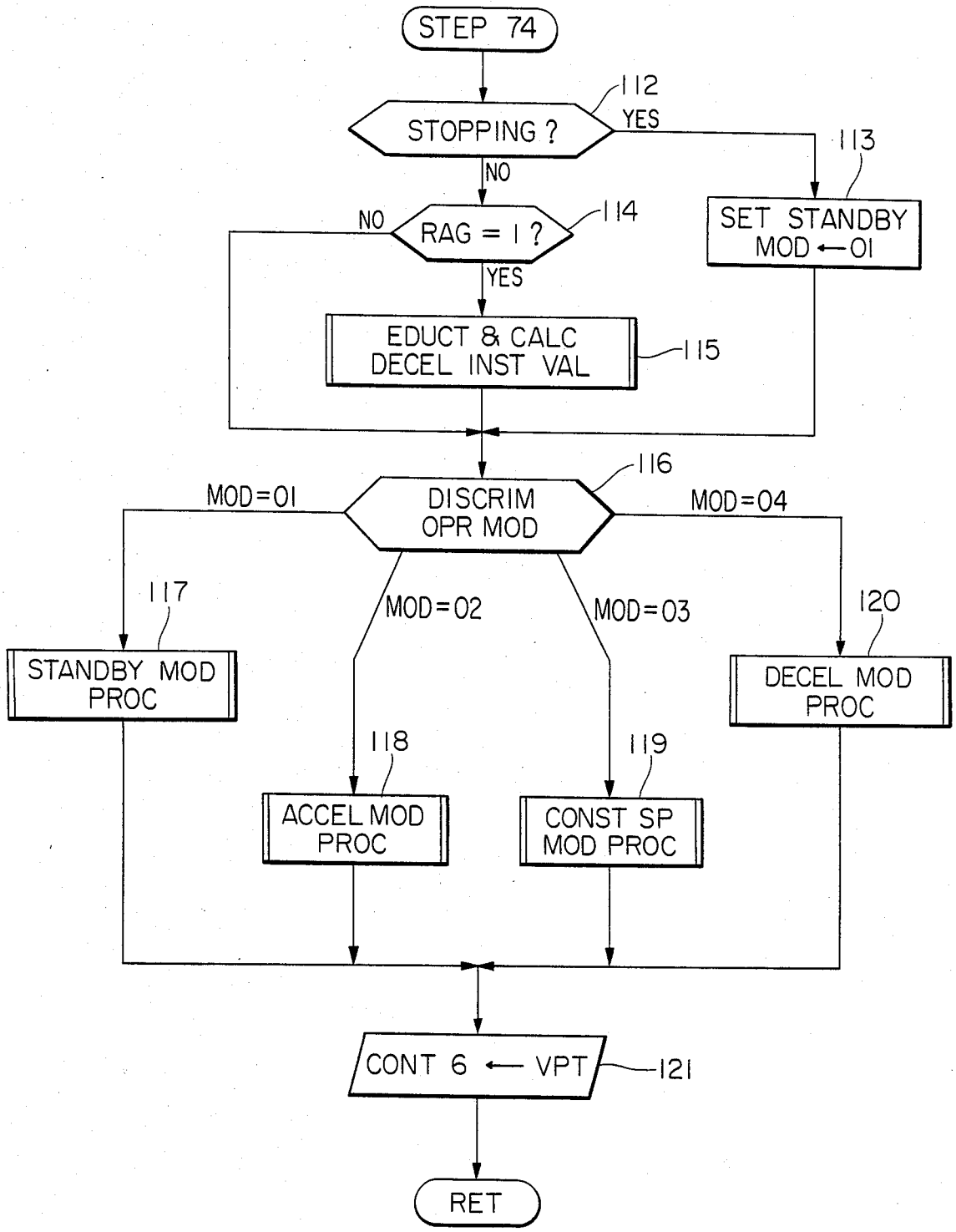

FIG. 10 illustrates step 74 of calculating the speed instruction value.

In step 112, it is determined whether or not the cage 1 is stopping. When the cage 1 is stopping, the operating mode flag MOD is set to a standby mode (01) (FIG. 16) in step 113. When the cage 1 is not stopping, the step is advance to next step 114, and the state of the flag RAG is determined. When the flag RAG is set to "1", and hence when the remaining distance is being calculated in the step 72, a deceleration instruction value is outputted and calculated in step 115. In step 116, the state of the operating mode flag MOD is determined. In case MOD=01, the step is advanced to step 117 of processing in a standby mode, in case MOD=02, the step is advance to step 118 of processing in a constant speed mode, in case MOD=03, the step is advance to step 119 of processing in constant speed mode, in case MOD=04, the step is advance to step 120 of processing in a deceleration mode. The speed instruction value VPT is eventually outputted to the controller 6 in step 121, and the series of processings are thus completed.

Figure 11:
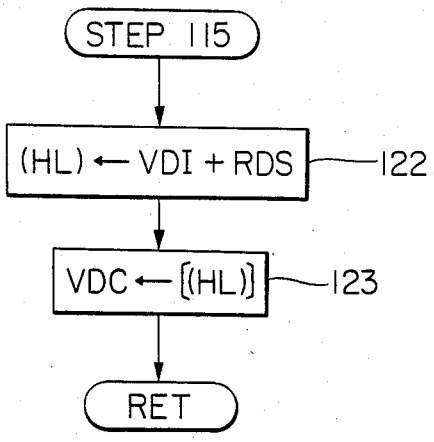

FIG. 11 illustrates the details of the step 115 of outputting and calculating the deceleration instruction value.

In step 122, the value of the sum of the heading address VDI of the deceleration instruction value data table corresponding to the remaining distance stored in the ROM 24 and the content (binary number) of the remaining distance RDS is set in an index resister HL, a deceleration instruction value is extracted from the address designated by the index register HL in step 123, and is stored as the deceleration instruction value VDC in a predetermined address of the RAM 25.

FIGS. 12 through 15 respectively illustrate processing steps 117 through 120 of the operating modes.

Figure 12:
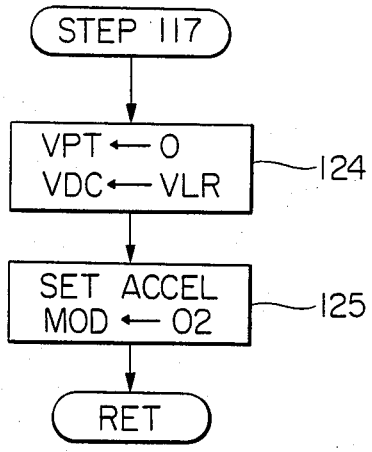

FIG. 12 illustrates the processing of the standby mode (01). In step 124, the speed instruction value VPT set in a predetermined address of the RAM 25 is reset to zero, and the speed instruction value VDC is set at the rated speed VLR. Then, in step 125, the operating mode flag MOD is set to an acceleration mode (02).

Figure 13:
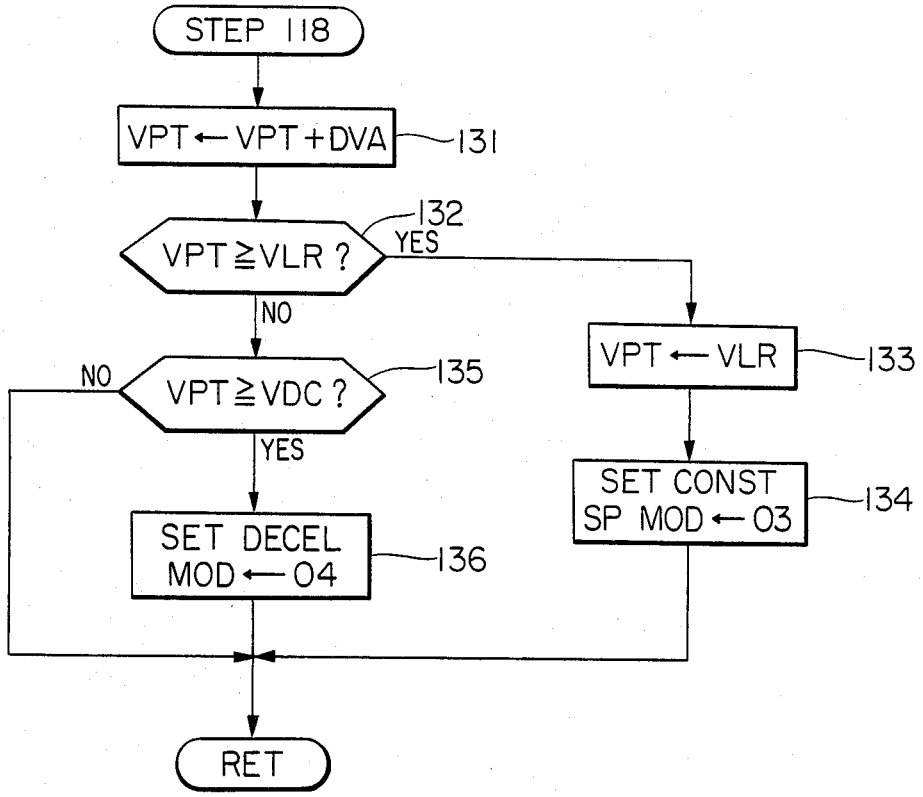

FIG. 13 illustrates the processing of an acceleration mode (02). In step 131, an acceleration increment value DVA (FIG. 16) is read from the ROM 24, and is added to the speed instruction value VPT stored in the RAM 25, and is again loaded as a speed instruction value VPT in the predetermined address of the RAM 25. In the next step 132, the speed instruction value VPT is compared in magnitude with the rated speed VLR. In case of VPT≧VLR, the step is advanced to step 133, the speed instruction value VPT is set to the rated speed VLR, and in the next step 134, the operating mode flag MOD is set to a constant speed mode (03). In case of VPT<VLR, the step is advanced to the step 135, the deceleration instruction value VDC is compared with the speed instruction value VPT. In other words, in case of VPT≧VDC, and the operating mode flag MOD is set to the deceleration mode (04) in the next step 136. In case of VPT<VDC, the process of the step 136 is ignored, and the processing of the acceleration mode (02) is completed.

Figure 14:
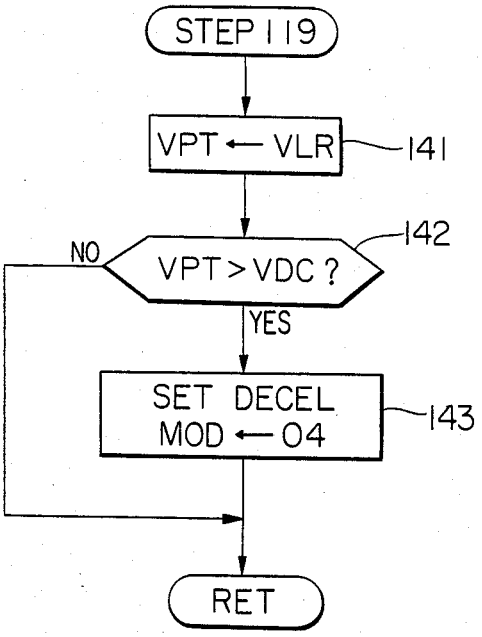

FIG. 14 illustrates the processing of a constant speed mode (03). In step 141, the speed instruction value VPT is maintained at the rated speed VLR. In step 142, the speed instruction value VPT is compared in magnitude with the rated speed VDC. In case of VPT>VDC, the operating mode flag MOD is set to (04) as in step 143. In case of VPT≦VDC, the step 143 is not executed, but the step 119 is completed.

Figure 15:
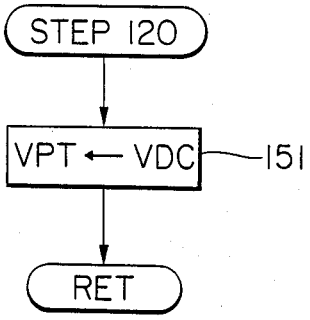

FIG. 15 illustrates the processing of a deceleration mode (04). In step 151, the deceleration instruction value VDC is read from a predetermined address of the RAM 25, and is set as the speed instruction value VPT.

Figure 16:
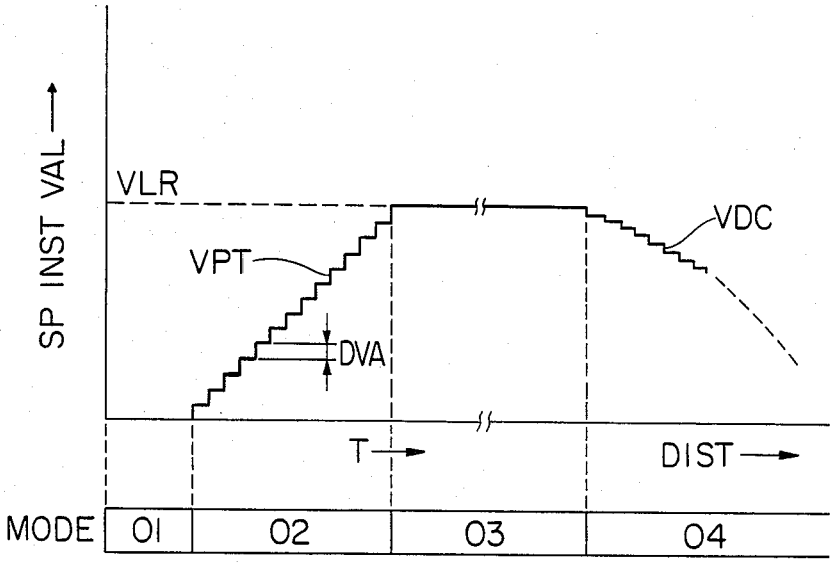
FIG. 16 is a graphical representation showing a speed instruction value curve and an operation mode transition diagram.

More particularly, when a start instruction is applied to the cage 1, the step 118 is carried out, and the speed instruction value VPT is increased with time as shown in FIG. 16. When the speed instruction value VPT is raised up to the rated speed VLR, the operating mode is transferred to the constant speed mode (03), and the speed instruction value VPT is maintained at the rated speed VLR as shown in FIG. 16. On the other hand, when the absolute position of the target floor to be stopped at is set as in the step 82, the remaining distance RDS is calculated in the step 83. When "1" is set in the flag RAG in the step 84, the deceleration instruction value VDC of the step 115 is outputted and calculated. The deceleration instruction value VDC decreases as the remaining distance RDS reduces and hence the cage approaches the target floor. Then, in step 142, if the relation becomes VPT>VDC, the operating mode is transferred to the deceleration mode (04).

As an example, it is assumed that a detection displacement occurs. At this time, the remaining distance RDS decreases, and the first position detector 12 is activated before the distance RDS becomes the distance L. Then, the counter 11 stops counting as in the steps 105 to 106. Thus, the calculated remaining distance RDS does not change. Then, the deceleration instruction value VDC is maintained at the speed instruction value $V_d$ as shown in FIG. 4(*b*). The cage 1 runs in this state, and when the door opening and closing capability zone is detected, the count restart instruction is outputted to the counter 11 as in the steps 109 through 111.

Thereafter, the calculated remaining distance RDS starts decreasing as the cage 1 runs. Then, the deceleration instruction value VDC reduces as shown in FIG. 4(*b*). Similarly, when the calculated remaining distance RDS becomes the distance L, and the first position detector 12 has not yet been activated due to a detection displacement, the following occurs: the count stop instruction is again outputted to the counter 11 as in the step 103. In this manner, the calculated remaining distance RDS is again maintained at the distance L. Then, the deceleration instruction value VDC is also maintained at the speed instruction value $V_{p1}$. Thereafter, the first position detector 12 is operated at the position C' before the predetermined distance L from the next floor B', and the counting of the counter 11 is then restarted as in the step 104. At this point, the calculated remaining distance RDS becomes equal to the actual remaining distance L. Therefore, the cage 1 can be controlled accurately at the floor with the deceleration instruction value VDC corresponding to the remaining distance thereafter.

As is apparent from the above description, in accordance with the present invention, a detection displacement can be detected before the cage 1 arrives at the door opening and closing capability zone E. Then, the operations of the arriving cage at the floor A is continued and the door does not open, thereby preventing the operation of the door opening allowable speed monitor. Further, the speed instruction value $V_p$ does not become lower than the speed instruction value $V_{p1}$ even at the floor position A and the cage 1 does not stop before is the actual floor position B. In addition, the engaging elements 12A and 13A are provided only at the actual floors. Therefore, even if a stop instruction to the cage is produced for an erronous floor position, the cage will not stop at the erroneous position. Moreover, since the speed instruction value $V_p$ is maintained at the speed $V_d$ higher than the speed instruction value $V_{p1}$, the cage running time can be minimized.

What is claimed is:

1. Apparatus for controlling the arrival of an elevator cage at an elevator floor including a computer in which the present position of the elevator cage is calculated according to pulses generated whenever the cage runs a certain distance, the present position of said cage is subtracted from the position of a target floor where the cage is to be stopped and stored in advance as the absolute position from a reference position calculated as the remaining distance to said target floor, and a calculated deceleration instruction value corresponding to the calculated remaining distance is produced to control the running speed of the cage to decelerate and stop said cage at said target floor, said target floor having a position detecting means disposed to be activated when said cage arrives at a predetermined distance before said target floor, and said computer including an arithmetic unit for maintaining said calculated deceleration instruction value until said position detecting means is activated.

2. The apparatus of claim 1 wherein said arithmetic unit generates a deceleration instruction value based on said predetermined distance after said position detector is activated.

3. The apparatus of claim 1 wherein said position detecting means comprises an engaging element installed at a predetermined distance before each floor, and a detector installed on part of said cage, said detector being activated upon engagement with said engaging element.

4. The apparatus of claim 3 wherein said detector comprises switching means, and the switching operation of said switching means is inputted as a signal to said arithmetic unit.

5. The apparatus of claim 1 wherein said arithmetic unit comprises an input converter for converting an input into a predetermined signal, a memory for storing elevator controlling programs, deceleration instruction values, and absolute floor positions, a memory for storing data for driving and controlling said elevator, a central processing unit, and an output converter for converting output information from said central processing unit into a signal for the elevator equipment.

6. Apparatus for controlling the arrival of an elevator cage at an elevator floor including a computer in which the present position of the elevator cage is calculated according to pulses generated whenever the cage runs a certain distance, the present position of said cage is subtracted from the position of a target floor where the cage is to be stopped and stored in advance as the absolute position from a reference position calculated as the remaining distance to said target floor, and a calculated deceleration instruction value corresponding to the calculated remaining distance is produced to decelerate and stop said cage at said target floor, said target floor having a first position detecting means disposed to be activated when said cage arrives at a predetermined distance before said target floor, and a second position detecting means disposed to be activated when said cage arrives at a door opening and closing capability zone for said target floor, said computer including an arithmetic unit for maintaining said calculated deceleration instruction value until said second position detecting means for said target floor is activated.

7. The apparatus of claim 6 wherein said arithmetic unit generates a predetermined deceleration instruction value based on said predetermined distance when a first position detecting means for the next floor to said target floor is activated.

8. The apparatus of claim 6 wherein said second position detecting means comprises engaging elements installed at each floor for setting a door opening allowable zone, and a detector installed on part said cage for detecting a door opening allowable zone upon engagement with said engaging element.

9. The apparatus of claim 6 wherein said second position detecting means comprises switching means, and operation of said switching means is inputted as a signal to said arithmetic unit.

10. An apparatus for controlling the arrival of an elevator cage at a floor including a computer in which the present position of said elevator cage is calculated according to pulses generated whenever the cage runs a certain distance, the present position of said cage is subtracted from the position of a target floor where said cage is to be stopped and stored in advance as the absolute position from a reference position calculated as the remaining distance to said target floor, and a calculated deceleration instruction value corresponding to the calculated remaining distance is produced to decelerate and stop said cage at said target floor, said target floor having a first position detecting means disposed to be activated when said cage arrives at a predetermined distance before said target floor, and a second position detecting means disposed to be activated when said cage reaches a door opening and closing capability zone for said target floor, and said computer including an arithmetic unit (1) for generating said calculated deceleration instruction value, (2) for generating and maintaining a predetermined deceleration instruction value corresponding to said predetermined distance if said calculated remaining distance of said cage equals said predetermined distance before said cage arrives at said first position detecting means for said target floor, (3) for maintaining said calculated deceleration instruction value until said second position detecting means for said target floor is activated when said calculated remaining distance of said cage is greater than said predetermined distance in the case when said first position detecting means is activated, setting thereafter said predetermined distance as said calculated remaining distance, maintaining said predetermined distance until said first position detecting means of the next floor is activated and generating said predetermined deceleration instruction value.

* * * * *